United States Patent [19]

Hsiao et al.

[11] 4,237,587

[45] Dec. 9, 1980

[54] PAPER CLIP

[76] Inventors: Oliver T. W. Hsiao; Thomas Tan, both of 2nd Fl., 168-1 Chien-Kue S. Rd., Nan-Mei Bldg., Taipei, Taiwan

[21] Appl. No.: 60,759

[22] Filed: Jul. 26, 1979

[51] Int. Cl.[3] ..... B42F 1/02; A44B 21/00

[52] U.S. Cl. ..... 24/261 R; 24/67 R; 24/67.3; 24/67.9; D19/65

[58] Field of Search ..... 24/261 R, 261 C, 261 F, 24/67 R, 67.9, 67.3, DIG. 8, DIG. 9; D19/65

[56] References Cited

U.S. PATENT DOCUMENTS

| | | | |
|---|---|---|---|
| D. 24,873 | 11/1895 | Merrill et al. | D2/451 |
| D. 28,534 | 5/1898 | Thomson | D19/65 |
| 868,747 | 10/1907 | Alter | 24/261 R |
| 1,167,734 | 1/1916 | Anderson | 24/261 R |
| 1,310,587 | 7/1919 | Sumersille | 24/67.9 |
| 2,518,179 | 8/1950 | Quinby et al. | 24/261 R |
| 2,908,954 | 10/1959 | Chaun | 24/261 R |
| 2,910,749 | 11/1959 | Parker | 24/67.9 |
| 2,976,594 | 3/1961 | Fauteux | 24/261 R |
| 4,170,052 | 10/1979 | Okerblom | 24/67.9 |

FOREIGN PATENT DOCUMENTS

| | | | |
|---|---|---|---|
| 1100054 | 9/1955 | France | 24/261 R |
| 1468047 | 12/1966 | France | 24/261 F |

*Primary Examiner*—Victor N. Sakran

[57] ABSTRACT

A paper clip formed as an essentially unitary loop is made of resilient material and comprises an isosceles triangle base portion, a first clipping portion and a second clipping portion. The first clipping portion and the second clipping portion can clip positively the documents in different directions respectively.

5 Claims, 2 Drawing Figures

PAPER CLIP

BACKGROUND OF THE INVENTION

1. FIELD OF THE INVENTION

This invention relates to a clip for fastening paper, documents or the like, and more particularly to a clip, having two clipping portions of different directions, which can positively clip a relative large number of documents without causing any damages to the documents clipped thereto during the user's drawing out the paper therefrom.

2. DESCRIPTION OF THE PRIOR ART

In the treatment of office business, clip is one of the most popular stationery. Many kinds of clips have been known in the art. FIG. 1 shows one of the oldest and still widely used conventional clips which comprises two U-shaped arms positioned approximately on the same plane so as to form a clamping portion. This kind of clip has the following drawbacks:

Since the U-shaped arms of the conventional clip are positioned on the same plane approximately, the number of sheets of paper to be clipped thereto is limited. In other words, if the quantity of paper is beyond the limit of the maximum allowance representing as the yield point of the material used to fabricate the clip, the reversing elasticity of the U-shaped arms of the clip will be yielded and the clip can neither fasten positively the paper any more nor return to its original position even if the paper is drawn out by the user. This drawback causes the user great inconvenience in the office work. Furthermore, free ends *5a, 5b* of the conventional clip are in a pointed shape, hence, it tears the paper clipped thereto easily when the user draws out the paper.

To overcome the last drawback of the above-mentioned conventional clip, a new kind of clip made of plastics has appeared in the market in recent years. Undoubtedly, the plastic clip avoids tearing the paper clipped thereto, but it fails to provide a desirable clamping effect due to the low reversing elasticity of the plastics and the number of the paper to be clipped thereto is restricted as a result.

SUMMARY OF THE INVENTION

Accordingly, it is a primary object of the present invention to provide a clip of considerable elasticity which is suitable for clamping not only a large number of paper but also less sheets of paper without tearing the paper.

It is another object of the present invention to provide a clip including two clipping portions of different directions wherein one of the clipping portions thereof is adapted to clip a large number of paper while another one is intended for clipping less sheets of paper.

According to this invention, a clip formed as an essentially unitary loop is made of resilient material and has an isosceles triangle base portion, a pair of bent connecting portions extending apart outwardly from one angle of the triangle base portion and bending upwardly and reversely until they meet each other at a point so as to form a first clipping portion, and two end portions bent to be essentially parallel and tightly contact to the isosceles arms of the triangle base protion respectively so as to form a second clipping portion.

The various features of novelty which characterize the invention are pointed out with particularity in the claims annexed thereto and forming a part of this specification. For a better understanding of the invention, its operating advantages, and specific objects attained by its use, reference should be made to the accompanying drawings and descriptive matter in which there is illustrated and described a preferred embodiment of the invention.

DETAILED DESCRIPTION OF THE PREFERRED EMBODIMENT

Figure 1:
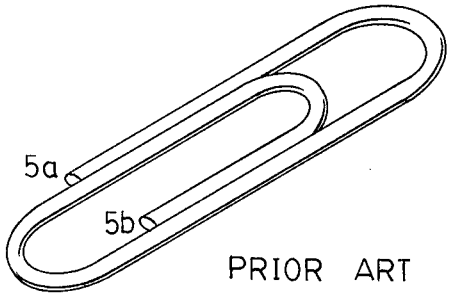
FIG. 1 is a perspective view of a conventional clip.
Figure 2:
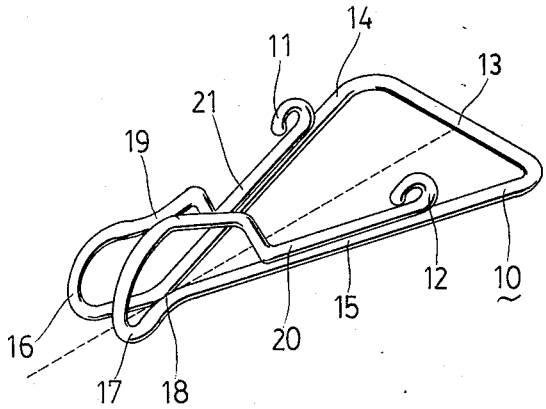
FIG. 2 is a diagrammatic perspective view of a preferred embodiment in accordance with the present invention.

Referring now to FIG. 2, there is shown a preferred embodiment of the present invention. The clip of the preferred embodiment being taken in the form of a unitary loop is made of resilient materials such as metal wire and comprises an isosceles triangle base portion 10 having a base arm 13, and two isosceles arms 14, 15 extending from two ends of the base arm 13 respectively. Said two isosceles arms 14, 15 contact each other at a first connecting point 18 positioned on a line which is perpendicular to the base arm 13 and passes through the middle point of said base arm 13 (shown as a broken line in FIG. 2). After passing through the first connecting point 18 the isosceles arms 14, 15 extend apart outwardly and bent upwardly to act as a pair of clamping jaws 16, 17, and then, bent reversly approaching to contact each other at an another point 19 which is positioned on an imaginary line perpendicular to the said broken line as shown in FIG. 2 so as to form a first clipping portion.

A pair of end portions 11, 12 extending from the clamping jaws 16, 17 is provided with a horizontal arm 20, 21 which are contacted closely and parallel to the isosceles arms 14, 15 of the triangle base portion 10 respectively so as to form a second clipping portion. The free end of said two end portions 11, 12 is warped to form a small loop 22, 23 so that the damage done to the paper may be minimized during the user's drawing out the paper.

Since a suitable space is provided between the two clamping jaws 16 and 17, a relative large number of documents can be held together by the first clipping portion. The horizontal arms 20, 21 contact closely with the isosceles arms 14, 15 of the triangle base portion 10 so that the second clipping portion is adapted to clip less sheets of paper. Therefore, the user may decide whether to use the first clipping portion or the second clipping portion in accordance with the actual need.

While the described embodiment represents the preferred from the present invention, it is to be understood that modifications will occur to those skilled in this art without aparting from the spirit of the invention. The scope of the invention is therefore to be determined solely by the appended claims.

What is claimed is:

1. A paper clip made of a single piece of metal wire comprising:

an isosceles triangle base portion having a base arm and two isosceles arms extending from two ends of said base arm respectively and contacting each other at a first connecting point;

a first clipping portion having two clamping jaws extending apart outwardly from said first connecting point of said isosceles arms and bending upwardly and reversly approaching to contact each other at a second connecting point whereby to permit a relative number of documents to be clipped therebetween; and a second clipping portion including two horizontal arms contact closely and parallel to said two isosceles arms respectively so as to clip less sheets of documents.

2. A paper clip as claimed in claim 1, wherein a free end of each said horizontal arm is warped to form a small loop so that any damages done to the documents clipped thereto will be avoided during the user's drawing out the documents.

3. A paper clip as calimed in claim 1, wherein said first clipping portion and said second clipping portion are so arranged that paper can be clipped thereto in different directions simultaneously.

4. A paper clip as claimed in claim 1, wherein said second connecting point of said clamping jaws is positioned on an imaginary line perpendicular to said first connecting point of said isosceles arms of said triangle base portion.

5. A paper clip as claimed in claim 4, wherein said first connecting point is positioned on an imaginary line which is perpendicular to said base arm of said triangle base portion and passes through the middle point of said base arm.

* * * * *